United States Patent [19]

Pantke et al.

[11] B 3,995,996

[45] Dec. 7, 1976

[54] AGENTS FOR IMPROVING WET FASTNESS PROPERTIES

[75] Inventors: Hellmuth Pantke, Leichlingen; Karl Vogel, Cologne, both of Germany

[73] Assignee: Bayer Aktiengesellschaft, Leverkusen, Germany

[22] Filed: Apr. 27, 1973

[21] Appl. No.: 354,959

[44] Published under the second Trial Voluntary Protest Program on February 17, 1976 as document No. B 354,959.

[30] Foreign Application Priority Data

Apr. 27, 1972 Germany ..... 2220710

[52] U.S. Cl. ..... 8/74; 8/165

[51] Int. Cl.[2] ..... D06P 5/02

[58] Field of Search ..... 8/74, 165

[56] References Cited

UNITED STATES PATENTS

| | | | |
|---|---|---|---|
| 2,328,900 | 9/1943 | Grimm | 8/74 X |
| 3,232,695 | 2/1966 | Robin | 8/165 |
| 3,764,262 | 10/1973 | Hildebrand et al. | 8/169 |

OTHER PUBLICATIONS

Gagliardi, American Dyestuff Reporter, Jan. 1962, pp. 31–40.

*Primary Examiner*—Donald Levy
*Attorney, Agent, or Firm*—Plumley and Tyner

[57] ABSTRACT

Improving the wet fastness properties of textile materials dyed from organic solvents with adducts of a. a customary agent for improving wet fastness properties, b. a surface-active amine or amine oxide which contains at least one $C_{12}$–$C_{28}$-alkyl-or-alkenyl radical, whereby this radical is bound directly or via a bridging member to the aminorespectively amine oxide nitrogen atom and c. an anionic surface-active agent.

16 Claims, No Drawings

AGENTS FOR IMPROVING WET FASTNESS PROPERTIES

The invention relates to agents for improving the wet fastness properties of dyeings produced on textile materials; more particularly it concerns agents for improving the wet fastness properties of dyeings produced on textile materials from organic water-immiscible solvents which contain, as active compounds, adducts, soluble in these solvents, of *a*, a customary agent for improving wet fastness properties, *b*, a surface-active amine or amine oxide which contains at least one $C_{12}$–$C_{28}$-alkyl-or-alkenyl radical, whereby this radical is bound directly or via a bridging member to the amino- respectively amine oxide nitrogen atom and *c*, an anionic surface-active agent, in which the components *a*, *b* and *c* are advantageously present in such equivalent ratios that *a : b* and *a : c* is 1 : 1–5, preferably 1 : 2 – 3 and *b : c* is 1 – 1.2 : 1.2 – 1.

The invention further relates to a process for improving the wet fastness properties of dyeings produced on textile materials from organic water-immiscible solvents; the process is characterised in that the agents for improving wet fastness properties which are used are adducts of *a*, a customary agent for improving wet fastness properties, *b*, a surface-active amine or amine oxide which contains at least one $C_{12}$–$C_{28}$-alkyl-or-alkenyl radical, whereby this radical is bound directly or via a bridging member to the amino- respectively amine oxide notrogen atom and *c*, an anionic surface-acitve agent, in which the components *a*, *b* and *c* are advantageously present in such equivalent rations that *a : b* and a – c is 1 : 1–5, preferably 1 : 2 – 3 and *b : c* is 1 – 1.2 : 1.2 – 1.

The agents according to the invention can be used both for improving the wet fastness properties of dyeings produced on cellulose materials with direct dyestuffs and of dyeings produced on textile materials of synthetic polyamides by means of acid dyestuffs, cationic dyestuffs or dispersion dyestuffs.

To improve the wet fastness properties of the dyeings produced with direct dyestuffs on cellulose materials, component a used in the agents to be employed according to the invention are the customary cationic agents for improving wet fastness properties such as are described, for example, in Diserens "Die neuesten Fortschritte in der Anwendung der Farbstoffe" ("The Most Recent Advances in the Use of Dyestuffs"), 2nd. edition, 1949, volume 2, especially pages 58 – 80 and pages 96 – 103, and also in Lindner "Tenside, Textilhilfsmittel, Waschrohstoffe" ("Surface-active Agents, Textile Auxiliaries and Raw Materials for Washing Agents"), 2nd. edition 1964, volume 1, pages 1,017 – 1,019, and in German Pat. Nos. 763,183, 833,708, 895,439, 928,713 and 1,104,926. The basic condensation products described in DBP Nos. 833,708 and 928,713 have proved particularly successful.

To improve the wet fastness properties of the dyeings produced with acid dyestuffs, cationic dyestuffs or dispersion dyestuffs on synthetic polyamides, component a employed in the agents to be used according to the invention are the customary anionic agents for improving wet fastness properties from the series of the synthetic tanning agents, for example polycondensation products, containing sulphonic acid groups, of phenols, especially hydroxydiarylsulphones, and formaldehyde, or co-condensation products of dihydroxydiarylsulphones, especially dihydroxydiphenylsulphone, and aromatic sulphonic acids, especially phenolsulphonic acid or naphthalenesulphonic acid; or formaldehyde condensation products of aromatic sulphonic acids such as are described, for example, in British Pat. Specification No. 1.258.012. The agents for improving wet fastness properties described in DBP No. 1,203,727 and in British Pat. Specifications Nos. 1,283,284 and 1,291,784 have proved particularly successful.

As examples of representatives of the amines or amine oxides, containing at least one $C_{12}$–$C_{28}$-alkyl-or-alkenyl radical whereby this radical is bound directly or via a bridging member, such as a phenyl, benzyl or —CO—NH—alkylene-group. to the amino respectively amine oxide nitrogen atom, to be used as component *b* in the agents according to the invention for improving wet fastness properties, there may be mentioned: primary, secondary and tertiary monoamines, for example optionally substituted aliphatic monoamines, such as dodecylamine, tetradecylamine, hexadecylamine, octadecylamine, octadecenylamine, N-methyl-hexadecylamine, N-methyl-octadecylamine, N,N-dimethyl-dodecylamine, N,N-dimethyl-hexadecylamine, N,N-diethyl-tetradecylamine, N,N-dibutyl-octadecylamine, N,N-di-dodecyl-methylamine, N,N-di-tetradecyl-ethylamine, N,N-di-octadecyl-methylamine and N,N-bis-2-hydroxyethyl)-oleylamine; also alkoxylation products of fatty amines, for example the reaction products of 1 mol of oleylamine and 7 mols of ethylene oxide, 1 mol of dodecylamine and 10 mols of ethylene oxide and 1 mol of octadecylamine and 8 mols of ethylene oxide; or their partial esters or partial ethers, for example the mono-lauric acid ester of the reaction product of 1 mol of oleylamine and 4 mols of ethylene oxide or the monomethyl ether of the reaction product of 1 mol of oleylamine and 4 mols of ethylene oxide; optionally substituted araliphatic monoamines, such as N,N-didodecylbenzylamine or (4-dodecylbenzyl)-amine; optionally substituted aromatic monoamines, such as N-dodecyl-aniline, N-tetradecyl-aniline, and 4-dodecyl-aniline; optionally substituted heterocyclic monoamines such as N-dodecyl-morpholine, N-hexadecyl-morpholine, N-dodecyl-piperidine, N-hexadecylpiperidine, N-dodecyl-imidazole, 1-(β-hydroxyethyl)-2-octadecyl-imidazoline, 1-(β-octadecanoylaminoethyl)-2-octadecylimidazoline and N-dodecyl-pyridinium chloride; primary, secondary and tertiary polyamines, for example optionally substituted aromatic polyamines, such as N-methyl-N-dodecyl-p-phenylenediamine or N-methyl-N′-octadecenoyl-p-phenylenediamine and especially optionally substituted aliphatic polyamines, such as N-dodecyl-N′,N′-dimethyl-ethylenediamine, N-hexadecyl-N′,N′-dimethyl-ethylenediamine, N-octadecyl-N′, N′-diethyl-ethylenediamine, N-oleyl-N′, N′-dimethyl-propylenediamine, N-dodecyl-ethylene-triamine, N-octadecyl-ethylenetetramine, N,N′-dioctadecyl-ethylenediamine, N,N′-dihexadecyldiethylenetriamine, N,N′-dioctadecyl-diethylenetriamine, N,N′-dioleyl-triethylenetetramine, N,N′-distearoyl-diethylenetriamine, N,N′-dioleyl-triethylenetetramine, N,N′-dibehenoyl-triethylenetetramine, N-methyl-N-(2-hydroxyethyl)-N-oleoylpropylenediamine, and N-oleoyl-N-(2-hydroxyethyl)-N′,N′-bis-(2-hydroxyethyl)-ethylenediamine; oxides of tertiary araliphatic, aromatic, heterocyclic and especially aliphatic monoamines or polyamines, for example N,N-dimethyl-oleylamine oxide, N,N-dibutyldodecylamine oxide, bis-(2-hydroxyethyl)-oleylamine oxide, N,N'-dioctadecyl-N,N'-diethyl-ethylenediamine dioxide, N,N-bis-(2-hydroxyethyl)-4-dodecylaniline N-oxide, N-methyl-N-dodecyl-cyclohexylamine oxide, N-hexadecylmorpholine N-oxide and also amine oxides of the reaction products of fatty amines with ethylene oxide, for example the amine oxide of the reaction product of 1 mol of dodecylamine and 10 mols of ethylene oxide or the reaction product of 1 mol of oleylamine and 8 mols of ethylene oxide.

Amines and amine oxides of the formula

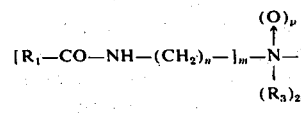

or

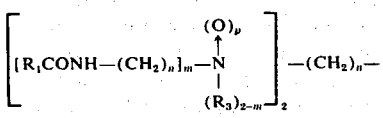

in which $R_1$ represents a $C_{12}$–$C_{28}$-alkyl or alkenyl radical, $R_2$ and $R_3$ independently of one another denote hydrogen, a $C_1$-$C_6$-alkyl radical which is optionally substituted by a chlorine atom, a nitrile group or preferably a hydroxyl group, a benzyl radical which is optionally substituted by chlorine atoms or $C_1$–$C_4$-alkyl groups or a polyethylene glycol ether chain, with the number of the ethylene oxide units in the molecule not being allowed to exceed 12, or together form a morpholine, piperidine or piperazine ring, $n$ is 2 or 3, $m$ is 1 or 2 and $p$ is 0 or 1, with the proviso that $R_2$ and $R_3$ can only be hydrogen if $p = 0$.

Representatives of these preferred amines or amine oxides are $(C_{17}H_{35}CONH—C_2H_4)_2NH$ $(C_{17}H_{33}CONH—C_2H_4)_2NH$ $(C_{18}H_{37}CONH—C_2H_4)_2NH$ $(C_{18}H_{35}CONH—C_2H_4)_2NH$ $C_{18}H_{35}co—nh—C_2H_4—NH—C_2H_4—NH—C_2H_4—NH—CO—C_{18}H_{35}$ $C_{17}H_{35}CO—NH—C_3H_6—N(CH_3)CH_2CH_2OH$ $(C_{18}H_{37}CONH\ C_3H_6\text{-})_2\ N—CH_3$

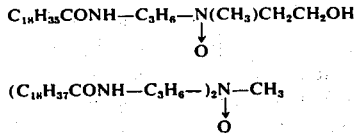

The amines might be present in form of their ammonium salts as well as quaternary ammonium compounds.

As examples of representatives of the anionic surface-active agents to be used as component c in the agents according to the invention for improving wet fastness properties, there may be mentioned: fatty acids, such as palmitic acid or oleic acid; $C_{10}$–$C_{24}$-alkylsulphonic acids, such as $C_{12}$–$C_{16}$-paraffinsulphonic acids; alkylarylsulphonic acids, such as i- or n-dodecylbenzenesulphonic acids, and dibutylnaphthalenesulphonic acids; acid sulphuric acid esters or phosphoric acid esters of fatty alcohols or fatty alcohol-, fatty amine-, alkylphenol- or fatty acid amine-alkylene oxide addition products, for example the acid sulphuric acid ester of Lorol (Lorol = $C_{12}$–$C_{15}$-alkanol mixture), of oleyl alcohol, or ricinoleic acid, of oleic acid ethanolamide or oleic acid N-methyl-ethanolamide, or the acid sulphuric acid esters of the reaction products of 1 mol of dodecyl alcohol and 3 mols of ethylene oxide, 1 mol of oleyl alcohol and 7 mols of ethylene oxide, 1 mol of dodecylamine and 10 mols of ethylene oxide and 1 mol of nonylphenol and 4 mols of ethylene oxide; sulphosuccinic acid esters, for example sulphosuccinic acid di-i-octyl ester and sulphosuccinic acid dinonyl ester.

The agents, to be used according to the invention, for improving the wet fastness properties are manufactured by mixing the components *a*, *b* and *c*, advantageously in the equivalent ratios indicated. In particular, to manufacture the agents for improving wet fastness properties for dyeings produced with direct dyestuffs on cellulose textile materials, components *b* and *c* are employed in the equivalent ratio of 1 – 1.2 : 1, whilst in agents for improving the wet fastness properties of dyeings produced with acid dyestuffs, cationic dyestuffs or dispersion dyestuffs on synthetic polyamides the equivalent ratio of *b* : *c* is 1 : 1 – 1.2, that is to say in the agents according to the invention, if they contain a cationic agent for improving wet fastness properties, the cationic surface-active agent is optionally present in a small excess over the surface-active agent of opposite polarity, whilst if they contain an anionic agent for improving wet fastness properties, the anionic surface-active agent is optionally present in a small excess over the surface-active agent of opposite polarity.

To accelerate the adduct formation it has proved advantageous to warm the mixture of the 3 components to 50° – 150°C, preferably 60° – 125°C. Warming is particularly indicated if not the free acids and amines, but the corresponding salts, are employed as components *a*, *b* and *c*. The reaction of the components to give the adducts is complete after about 10 to 150 minutes. To manufacture the adducts, the 3 components or their salts can be reacted in the presence of small amounts of water, in the melt or in diluents, such as water, water containing alcohol or organic water-immiscible solvents, for example aliphatic halogenated hydrocarbons, such as tetrachloroethylene.

The cellulose materials of which the dyeings are improved according to the invention are textile materials of natural or regenerated cellulose, such as cotton, linen, rayon or viscose staple; possible synthetic polyamides are both the normal synthetic polyamides which can be dyed with anionic or dispersion dyestuffs, and the synthetic polyamides which have been anionically modified and can be dyed with cationic dyestuffs, such as polyhexamethylenediamine adipate, poly-ε-caprolactam and poly-ω-aminoundecanoic acid. The fibre materials can be in the most diverse states of processing, such as filaments, yarn, woven fabrics, knitted fabric and made-up goods.

The adducts to be used according to the invention are added to the baths for improving the wet fastness properties in an amount of about 0.1 to 30 g, preferably 2 to 10 g/l of liquor.

Preferably, aliphatic halogenated hydrocarbons with a boiling point of between 40° and 170°C are used in the aftertreatment baths as organic water-immiscible liquids; trichloroethylene, tetrachloroethylene and 1,1,1-trichloroethane have proved particularly suitable.

In many cases it has proved advantageous if, additionally to the adducts to be used according to the invention, the post-treatment baths contain 0.5 to 50 g, preferably 3 to 15 g, of water/l of liquor.

The process according to the invention for improving the wet fastness properties of dyeings produced on textile materials from organic water-immiscible solvents is carried out by treating the dyed textile materials, in the solutions of the adducts according to the invention in the organic water-immiscible liquids, for about 10 to 40, preferably 15 to 30, minutes at 40° to 90°C, preferably 50° to 70°C, subsequently separating off the liquor and drying the textile material, if appropriate after rinsing with fresh organic solvent.

Using the agents, to be employed according to the invention, for improving wet fastness properties, an equivalent improvement in wet fastness properties is obtained from organic water-immiscible solvents to that hitherto only obtainable from aqueous baths. In the adducts, the presence of amines or amine oxides and anionic surface-active agents causes a substantial increase in the action of the agents for improving wet fastness properties.

The dyestuff numbers quoted in the examples which follow relate to the data in Colour Index, 3rd. edition, 1971, volume 4.

EXAMPLE 1

A. 19.32 g of N,N'-distearoyl-diethylenetriamine (0.03 equivalent), 6 g of 60% strength acetic acid and 11 g of oleyl sulphate (ammonium salt) (0.03 equivalent) are fused together at 80° to 90°C. 12.52 g of the condensation product manufactured from 1 mol of 4,4'-dihydroxydiphenylsulphone, 1 mol of formaldehyde and 0.33 mol of phenolsulphonic acid (according to German Offenlegungsschrift No. 1,960,616) are introduced into this melt. The reaction mixture is subsequently heated to 150°C and kept at this temperature for 60 minutes. The cooled melt can be powdered.

Yield: 43 g of a powder which is easily soluble in tetrachloroethylene.

B. A knitted fabric of polyhexamethylenediamine adipate which has been dyed with 2% by weight of the acid dyestuff No. 17,070, relative to the dry weight of the knitted fabric, is agitated for 30 minutes, in a liquor ratio of 1 : 20, in a tetrachloroethylene bath warmed to 60°C which contains, per liter, 4.3 g of the adduct described above and 8 ml of water. After the treatment, the knitted fabric is rinsed with fresh tetrachloroethylene and dried at about 80°C. After the treatment, the dyeing shows wet fastness values (determined according to DIN 54,002) of 4 to 5.

An equivalent improvement in wet fastness properties was also obtained if instead of the adduct employed one of the adducts described below was used in the amounts also indicated below.

Adduct A 1: 8 g (0.005 equivalent) of the formaldehyde-dihydroxydiphenyl condensation product, containing sulphonic acid groups, described in Example 1 of German Pat. No. 1,203,727 were dissolved at 60°C in a mixture of 10g (0.025 equivalent) of N-oleoyl-N'-methyl-N'-(2-hydroxyethyl)-propylenediamine, 10 g of glacial acetic acid, 9.1 g (0.025 equivalent) of oleyl sulphate (ammonium salt) and 6 g of water. 2.5 g of the clear mixture thus obtained were used per l of tetrachloroethylene treatment bath.

Adduct A 2: 10 g of the condensation product of 1 mol of 4,4'-dihydroxydiphenylsulphone, 1 mol of formaldehyde and 0.33 mol of phenolsulphonic acid are warmed to 70°C in 38.5 g of a mixture of 38.5% of N,N-dioctadecyl-N,N-dimethyl-ammonium chloride, 12.1% of isopropanol, 23.7% of oleyl sulphate (ammonium salt), 19.5% of glacial acetic acid and 6.2% of water until a homogeneous reaction mixture soluble in tetrachloroethylene has been produced. 5.5 g of this mixture were employed per l of tetrachloroethylene aftertreatment liquor.

Adduct A 3: 8.3 g (0.0083 equivalent) of the condensation product of 1 mol of 4,4'-dihydroxydiphenylsulphone, 1 mol of formaldehyde and 0.33 mol of phenolsulphonic acid are introduced, whilst stirring, into a mixture, heated to 75°C, of 200 ml of tetrachloroethylene, 11.5 g (0.02 equivalent) of the reaction product of 1 mol of oleylamine with 7 mols of ethylene oxide, 7.3 g (0.02 equivalent) of oleyl sulphate (ammonium salt), 6 g of glacial acetic acid and 2 g of water. The reaction mixture is warmed to 75° – 85°C until a clear solution has been produced. This solution can be added directly to the halogenated hydrocarbon post-treatment baths; in particular, 22.5 ml of this solution are used per l of treatment liquor.

EXAMPLE 2

A. 12.5 g (0.0125 equivalent) of the condensation product of 1 mol of 4,4'-dihydroxydiphenylsulphone, 1 mol of formaldehyde and 0.33 mol of phenolsulphonic acid are dissolved at 60°C in a mixture of 12 g (0.03 equivalent) of N-oleoyl-N'-methyl-N'-(2-hydroxyethyl)-propylenediamine, 20 g of 60% strength acetic acid and 11 g of oleyl sulphate (ammonium salt). After cooling the reaction solution to room temperature, a homogeneous viscous liquid is obtained.

B. A woven fabric of poly-ε-caprolactam filaments which has been dyed with 2% by weight of the acid dyestuff NO. 62,020, relative to the dry weight of the fabric, is agitated for 30 minutes, using a liquor ratio of 1 : 30, in a tetrachloroethylene bath warmed to 60°C, which contains, per l of tetrachloroethylene, 4.4 g of the adduct described above and 6 ml of water. Thereafter the fabric is rinsed with fresh tetrachloroethylene and dried at about 60°C.

After the treatment, the dyeing shows the following wet fastness values (determined by assessing the bleeding onto normal white ε-polycaprolactam according to DIN 54,002):

| | |
|---|---|
| Fastness to water, b (determined according to DIN 54,006): | 4 |
| Fastness to washing, mechanical wash at 40°C (determined according to DIN 54,014): | 4 – 5 |
| Fastness to perspiration, acid conditions (determined according to DIN 54,020): | 4 |
| Fastness to perspiration, alkaline conditions (determined according to DIN 54,020): | 4 |

An equivalent improvement in wet fastness properties was also obtained if instead of the adduct employed the adduct described below was used in the amounts also indicated below.

Adduct A 1: 10 g (0.01 equivalent) of the condensation product of 1 mol of 4,4'-dihydroxydiphenylsulphone, 1 mol of formaldehyde and 0.33 mol of phenolsulphonic acid are fused at 60°C with 10.7 g (0.03 equivalent) of N,N-bis-(2-hydroxyethyl)-oleylamine, 14 g of 60% strength acetic acid and 11.4 g (0.03 equivalent) of $C_{14}$-paraffinsulphonic acid (sodium salt; 80% water content). 3.75 g of the viscous melt, liquid at room temperature, obtained in this manner are used per liter of tetrachloroethylene treatment liquor.

EXAMPLE 3

A. 10 g (0.01 equivalent) of the dicyandiamide-formaldehyde condensation product described in the example of German Pat. No. 833,708 are dissolved at 60° – 70°C in a mixture of 12 g (0.03 equivalent) of N-oleoyl-N'-methyl-N'-(2-hydroxyethyl)-propylenediamine, 11 g (0.03 equivalent) of oleyl sulphate (ammonium salt), 12 g of glacial acetic acid and 13 g of water. The reaction product is a clear viscous liquid.

B. Cotton yarn which has been dyed with 2 per cent by weight of the direct dyestuff No. 35,780, relative to the dry weight of the yarn, is agitated for about 30 minutes, using a liquor ratio of 1 : 20, in a tetrachloroethylene bath warmed to 60°C which contains, per liter, 11.6 g of the reaction solution described above and 15 g of water. Thereafter the yarn is rinsed with fresh tetrachloroethylene and dried.

After the treatment, the dyeing shows the following wet fastness values (determined by assessing the bleeding onto normally white cotton fabric):

| | |
|---|---|
| Fastness to water, b (determined according to DIN 54,006): | 3 – 4 |
| Fastness to washing, mechanical wash at 40°C (determined according to DIN 54,014): | 3 |
| Fastness to perspiration, alkaline conditions (determined according to DIN 54,020): | 3 – 4 |
| Fastness to perspiration, acid conditions (determined according to DIN 54,020): | 3 |

EXAMPLE 4

A. 6.58 g (0.01 equivalent) of the condensation product of 2 mols of diphenyl ether, 1 mol of formaldehyde and 3 mols of sulphuric acid are warmed in a mixture of 12 g (0.03 equivalent) of N-oleoyl-N'-methyl-N'-(2-hydroxyethyl)-propylenediamine, 12 g of glacial acetic acid, 13 g (0.03 equivalent) of oleyl sulphate (ammonium salt) and 12 g of water at 100° to 110°C until a clear reaction solution has been produced. This reaction mixture is employed directly as an agent for improving wet fastness properties.

B. A knitted fabric of anionically modified polyhexamethylenediamine adipate which has been dyed with 2% by weight of the cationic dyestuff No. 11,085 is agitated for 30 minutes, using a liquor ratio of 1 : 20, in a tetrachloroethylene bath which has been warmed to 60°C and which contains, per liter, 20 g of the adduct described above and 15 g of water. Thereafter the knitted fabric is rinsed with fresh tetrachloroethylene and dried.

After the treatment, the dyeing shows the following wet fastness values (determined by assessing the bleeding onto normal white ε-polycaprolactam according to DIN 54,002):

| | |
|---|---|
| Fastness to water, b (determined according to DIN 54,006): | 3 – 4 |
| Fastness to perspiration, alkaline conditions (determined according to DIN 54,020): | 4 |

-continued

| | |
|---|---|
| Fastness to perspiration, acid conditions (determined according to DIN 54,020): | 3 – 4 |

EXAMPLE 5

A poly-ε-caprolactam fabric which was dyed with 2% by weight of the dispersion dyestuff of the formula

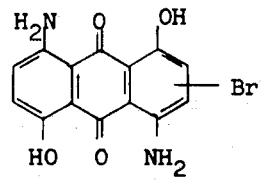

relative to the dry weight of the fabric is agitated for 30 minutes, using a liquor ratio of 1 : 20, in a tetrachloroethylene bath warmed to 60°C which contains, per liter, 4.4 g of the adduct described in Example 2 A. and 6 ml of water. Thereafter the fabric is rinsed with fresh tetrachloroethylene and then dried.

After the treatment, the dyeing shows the following wet fastness values (determined by assessing the bleeding onto normal white ε-polycaprolactam according to DIN 54,002):

| | |
|---|---|
| Fastness to water, b (determined according to DIN 54,006): | 4 |
| Fastness to washing, mechanical wash at 40°C (determined according to DIN 54,014): | 3 |
| Fastness to perspiration, alkaline conditions (determined according to DIN 54,020): | 4 – 5 |
| Fastness to perspiration, acid conditions (determined according to DIN 54,020): | 4 – 5 |

EXAMPLE 6

A knitted fabric of polyhexamethylenediamine adipate and anionically modified polynexamethylenediamine adipate, which has been dyed in a single bath with 0.75% by weight of the anionic dyestuff No. 13,425 and 0.75% by weight of the cationic dyestuff No. 11,085 is agitated, using a liquor ratio of 1 : 30, for 30 minutes in a tetrachloroethylene bath warmed to 60°C which contains, per liter, 5 g of the adduct described in Example 2 A. and 6 ml of water. Thereafter the knitted fabric is rinsed with fresh tetrachloroethylene and then dried.

| | Dyeings obtained with anionic dyestuff | cationic |
|---|---|---|
| Fastness to water, b (determined according to DIN 54,006): | 4 – 5 | 4 – 5 |
| Fastness to perspiration, acid conditions (determined according to DIN 54,020): | 4 – 5 | 4 |
| Fastness to perspiration, alkaline conditions (determined according to DIN 54,020): | 4 | 4 |

We claim:

1. Agents for improving the wet fastness properties of dyeings of cellulose materials with direct dyes and of dyeings produced on synthetic polyamides with acid dyes, cationic dyes or disperse dyes from organic water immiscible solvents comprising the organic water immiscible solvent soluble adduct of *a*, *b* and *c* wherein

*a* is a customary wet fastness improving agent selected from the group consisting of condensation products of formaldehyde with dicyandiamide, quanidine or dicyandiamide and guanidine; polyethylene polyamines; alkylated polyethylene polyamines; condensation products of formaldehyde and hydroxydiarylsulfones; co-condensation products of dihydroxydiarylsulfones, aromatic sulfonic acids and formaldehyde; and the alkali metal or ammonium salt of the condensation product of the condensation product of aromatic sulfonic acids and formaldehyde having the formula $$\left[ A \begin{array}{l} -(SO_3)_n \\ -(C_1-C_4\text{—alkyl})_m \end{array} \right]$$

wherein

A is diphenyl ether radical;

*m* is a whole number from 0 to 2; and

*n* is a number from 0.5 to 2;

*b* a surface-active amine or amine oxide which contains at least one $C_{12}$–$C_{28}$-alkyl or alkenyl radical which is directly attached or is attached via a phenyl, benzyl or —CO–NH-alkylene- bridging member to the amino or amine oxide nitrogen atom; and *c* an anionic surface-active agent.

2. Agents for improving wet fastness properties, according to claim 1, in which the components *a*, *b* and *c* are present in such equivalent ratios that *a* : *b* and *a* : *c* are 1 : 1 – 5 and *b* : *c* is 1 – 1.2 : 1.2 – 1.

3. Agents for improving wet fastness properties according to claim 1, in which the components *a*, *b* and *c* are present in such equivalent ratios that *a* : *b* and *a* : *c* are 1 : 2 – 3.

4. Agents for improving wet fastness properties, according to claim 2, which they contain, as component b, amines or amine oxides of the formula $$[R_1-CO-NH-(CH_2)_n-]_m-\overset{\overset{(O)_p}{\uparrow}}{\underset{\underset{(R_3)_{2-m}}{|}}{N}}-R_2$$

or $$\left[ [R_1CONH-(CH_2)_n]_m-\overset{\overset{(O)_p}{\uparrow}}{\underset{\underset{(R_3)_{2-m}}{|}}{N}} \right]-(CH_2)_n-$$

in which $R_1$ represents a $C_{12}$–$C_{28}$-alkyl or alkenyl radical, $R_2$ and $R_3$ independently of one another denote hydrogen, a $C_1$–$C_6$-alkyl radical which is optionally substituted by a chlorine atom, a nitrile group or preferably a hydroxyl group, a benzyl radical which is optionally substituted by chlorine atoms or $C_1$–$C_4$-alkyl groups or a polyethylene glycol ether chain, with the number of the ethylene oxide units in the molecule not being allowed to exceed 12, or together form a morpholine, piperidine or piperazine ring,

*n* is 2 or 3,

*m* is 1 or 2 and

*p* is 0 or 1 with the proviso that $R_2$ and $R_3$ can only be hydrogen if $p = 0$.

5. Agents for improving wet fastness properties, according to claim 2, which contain, as component c, fatty acids, $C_{10}$–$C_{24}$-alkylsulphonic acids, alkylarylsulphonic acids, acid sulphuric acid esters or phosphoric acid esters of fatty alcohols or fatty alcohol-, fatty amine-, alkylphenol- or fatty acid amide-alkylene oxide addition products or sulphosuccinic acid esters.

6. Process according to claim 12, in which the components *a*, *b* and *c* are present in such equivalent ratios that *a* : *b* and *a* : *c* are 1 : 1 – 5 and *b* : *c* is 1 – 1.2 : 1.2 – 1, are used as agents for improving wet fastness properties.

7. Process according to claim 12, in which the components *a*, *b* and *c* are present in such equivalent ratios that *a* : *b* and *a* : *c* are 1 : 2 – 3 are used as agents for improving wet fastness properties.

8. Process according to claim 12, in which the component *b* is an amine or amine oxide of the formula $$[R_1-CO-NH-(CH_2)_n-]_m-\overset{\overset{(O)_p}{\uparrow}}{\underset{\underset{(R_3)_{2-m}}{|}}{N}}-R_2$$

or $$\left[ R_1CONH-(CH_2)_n]_m-\overset{\overset{(O)_p}{\uparrow}}{\underset{\underset{(R_3)_{2-m}}{|}}{N}} \right]-(CH_2)_n-$$

in which $R_1$ represents a $C_{12}$–$C_{28}$-alkyl or alkenyl radical, $R_2$ and $R_3$ independently of one another denote hydrogen, a $C_1$–$C_6$-alkyl radical which is optionally substituted by a chlorine atom, a nitrile group or preferably a hydroxyl group, a benzyl radical which is optionally substituted by chlorine atoms or $C_1$–$C_4$-alkyl groups or a polyethylene glycol ether chain, with the number of the ethylene oxide units in the molecule not being allowed to exceed 12, or together form a morpholine, piperidine or piperazine ring,

*n* is 2 or 3,

*m* is 1 or 2 and

*p* is 0 or 1 with the proviso that $R_2$ and $R_3$ can only be hydrogen if $p = 0$, are used as agents for improving wet fastness properties.

9. Process according to claim 12, in which fatty acids, $C_{12}$–$C_{24}$-alkylsulphonic acids, alkylarylsulphonic acids, acid sulphuric acid esters or phosphoric acid esters of fatty alcohols or fatty alcohol-, fatty amine-, alkylphenol- or fatty acid amide-alkylene oxide addition products or sulphosuccinic acid esters are used as component c, are employed as agents for improving wet fastness properties.

10. Agents for improving wet fastness properties, according to claim 1 in which said component (a) is a polyethylene polyamine obtained by reacting a β-halogen ethylene amine with an alkali metal hydroxide in a solvent medium at pH 7 to 12.

11. Agents for improving wet fastness properties, according to claim 1 in which said *a* component is obtained by condensing in aqueous medium 1 mol of dicyandiamide with 0.75 to 1.5 mol of formaldehyde in presence of 0.33 to 0.75 mol of hydrogen chloride at a temperature up to 100°C., evaporating the water and heating the condensation product formed to a temperature from above 100°C. to 160°C.

12. A process for improving the wet fastness properties of dyeing produced on cellulosic materials with direct dyestuffs or of dyeings on polyamides from organic water immiscible solvents with acid dyes, cationic dyes or disperse dyes comprising after treating said dyed cellulosic material or polyamide with an agent which comprises the organic water immiscible solvent soluble adduct of *a*, *b* and *c* wherein

*a* is a customary wet fastness improving agent selected from the group consisting of condensation products of formaldehyde with dicyandiamide, guanidine or dicyandiamide and guanidine, polyethylene polyamines; alkylated polyethylene polyamines; condensation products of formaldehyde and hydroxydiarylsulfones; co-condensation products of dihydroxydiarylsulfones, aromatic sulfonic acids and formaldehyde; and the alkali metal or ammonium salt of the condensation product of the condensation product of aromatic sulfonic acids and formaldehyde having the formula

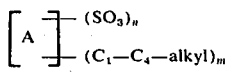

wherein

A is diphenyl ether radical,

*m* is a whole number from 0 to 1; and

*n* is a number from 0.5 to 2

*b* a surface-active amine or amine oxide which contains at least one $C_{12}$–$C_{28}$-alkyl or alkenyl radical which is directly attached or is attached via a phenyl, benzyl or —CO—NH-alkylene bridging member to the amino or amine oxide nitrogen atom; and *c* an anionic surface-active agent.

13. The process of claim 12 in which said component (a) is a polyamine obtained by reacting a β-halogen ethylene amine with an alkali metal hydroxide in a solvent medium at pH 7 to 12.

14. The process of claim 12 in which said component (*a*) is obtained by condensing in aqueous medium 1 mol of dicyandiamide with 0.75 to 1.5 mol of formaldehyde in presence of 0.33 to 0.75 mol of hydrogen chloride at a temperature up to 100°C., evaporating the water and heating the condensation product formed to a temperature from above 100° to 160°C.

15. The process of claim 12 wherein a cellulosic material dyed with a direct dye is treated and said (*a*) component is the condensation products of formaldehyde with dicyandiamide, quanidine or dicyandiamide and guanidine; polyamines; or polyamine derivatives.

16. The process of claim 12 wherein a polyamide dyed with an acid dye, cationic dye or disperse dye is treated and said component (*a*) is a condensation product of formaldehyde and hydroxydiarylsulfones; cocondensation product of dihydroxydiarylsulfones, aromatic sulfonic acids and formaldehyde; or the alkali metal or ammonium salt of the condensation product of aromatic sulfonic acids and formaldehyde having the formula

* * * * *